United States Patent [19]

With, deceased

[11] Patent Number: 4,768,804

[45] Date of Patent: Sep. 6, 1988

[54] DEVICE FOR ATTACHING A BOOT TO A SKI, ESPECIALLY A CROSS-COUNTRY RACING SKI OR CROSS-COUNTRY TOURING SKI

[75] Inventor: Bror With, deceased, late of Oslo, Norway, by Line With, heir

[73] Assignee: WITCO A/S, Oslo, Norway

[21] Appl. No.: 827,973

[22] PCT Filed: May 31, 1985

[86] PCT No.: PCT/NO85/00031

§ 371 Date: Mar. 18, 1986

§ 102(e) Date: Mar. 18, 1986

[87] PCT Pub. No.: WO85/05557

PCT Pub. Date: Dec. 19, 1985

[30] Foreign Application Priority Data

Jun. 1, 1984 [NO] Norway ..... 842227

[51] Int. Cl.[4] ..... A63C 9/18

[52] U.S. Cl. ..... 280/614

[58] Field of Search ..... 280/614, 615, 613, 611

[56] References Cited

U.S. PATENT DOCUMENTS

| | | | |
|---|---|---|---|
| 2,516,238 | 7/1950 | Mortsell | 280/615 |
| 2,610,067 | 9/1952 | Harby, Jr. | 280/614 |

FOREIGN PATENT DOCUMENTS

| | | | |
|---|---|---|---|
| 810603 | 8/1951 | Fed. Rep. of Germany . | |
| 2622966 | 4/1977 | Fed. Rep. of Germany | 280/615 |
| 2707887 | 8/1978 | Fed. Rep. of Germany . | |
| 2937347 | 6/1980 | Fed. Rep. of Germany . | |
| 3320559 | 12/1983 | Fed. Rep. of Germany . | |
| 109420 | 7/1966 | Norway . | |
| 140967 | 9/1979 | Norway . | |
| 145183 | 10/1981 | Norway . | |
| 147585 | 1/1983 | Norway . | |
| 44432 | 12/1916 | Sweden | 280/615 |
| 61821 | 2/1924 | Sweden | 280/615 |
| 83367 | 5/1935 | Sweden . | |
| 239970 | 3/1946 | Switzerland . | |
| 299398 | 6/1954 | Switzerland . | |

*Primary Examiner*—John J. Love
*Assistant Examiner*—Michael Mar
*Attorney, Agent, or Firm*—Cushman, Darby & Cushman

[57] ABSTRACT

A device for attaching a boot (5) to a ski (11), especially a cross-country racing or cross-country touring ski, comprising a locking assembly (**12,12*b*,14) on the ski (11), which co-operates with portions of the user's footwear for the attachment thereof to the ski. For the purpose of achieving a lockable connection between the boot and the ski which secures a good side guidance as well as free and unobstructed lifting movement upwardly to a correct, limited degree, at the same time permitting an orthopedicly correct boot, such as an ordinary hiking boot to be used, the present invention discloses a novel locking assembly (12*a*, 12*b*, 14) which is provided on the ski, when can co-operate with attachment portions (6, 7) which are defined in the footwear sole surface (1) in the area of the toe portion (2') of the foot. By this form of attachment device may be the boot locked to the ski in the area of the axis of the pivoting movement of the foot, allowing the foot to swing about a fixed axis without play, which allows for good control of the skis, even with a completely swung-up foot. Attachment portions (51*a*,51*c*; 51*b*, resp.) having individual locking mechanisms (552,55*c*; 55*b*, resp.) permitting displacement of the attachment point of the sole relative to the binding (54**) are also disclosed.

5 Claims, 7 Drawing Sheets

DEVICE FOR ATTACHING A BOOT TO A SKI, ESPECIALLY A CROSS-COUNTRY RACING SKI OR CROSS-COUNTRY TOURING SKI

The present invention relates to a device for attaching a boot to a ski, especially a cross-country racing ski or a cross-country touring ski, comprising locking means provided on the ski for co-operating with portions of the user's footwear for the attachment thereof to the ski.

The object of the present invention is to provide such a device, which fulfils the following requirements:

1. Good and safe side guidance when used during cross-country racing and cross-country touring.

2. Free and unobstructed lifting movement relative to the ski with a lifting movement which can be limited correctly upwardly.

3. A ski boot which has a more correct orthopedic structure than boots having extended sole tips.

4. A ski binding and a footwear which both have a low and compact,construction.

5. A ski boot which can be used not only for cross-country racing and touring, but also as a usual hiking footwear having a sole adapted to the natural shape of the foot.

These requirements are fulfilled by a ski boot attachment device constructed according to the present invention. The present invention is characterized in that the locking means, which are provided on the ski, co-operate with attachment portions provided in the sole surface of the footwear in the area of the toe portion of the foot.

In a simple embodiment for achieving a best possible side guidance the sole portion of the footwear in the area of the toe portion of the foot can be structured as one or more channels, the channels gripping over a corresponding guiding- and locking rail provided on the foot plate of the ski binding. If only one transversely extending channel is used, it is possible in practice to achieve a 60 to 65 mm wide support of the boot on the ski.

The footwear or boot is attached to the guiding rail or locking means by forming the guiding rail such that it in a first position allows for insertion of the guiding rail in the transversely extending channel in the boot sole below the toe tip, whereas it in another position, the locking position, keeps the footwear sole secured to the guiding and locking rail. The type of support thereby achieved will render a far safer side guidance than what is achieved in connection with bindings in which the sole, which is often heavily bent, is to be supported against the ears or toe irons of the binding.

The requirement of a free and unobstructed lifting movement of the foot is fully met in that the supporting or hinge device according to the invention functions as a bearing. Besides, the device renders it possible to have full control of the degree of freeness, for example by means of an adjustable spring loaded abutment.

The clamping means, which keeps the sole down towards the locking rail, can also be so constructed so that the clamping point can be adjusted. Thus, if the clamping point is displaced to a sole area which comes into effect "behind" the guiding rail, there is achieved a "firm" binding which can be appropriate in loose snow or in downhill skiing. If the clamping point is set right above the guiding rail, there is achieved a so to say unloaded or free hinge effect. A prerequisite for this unloaded hinge effect is that the sole tip which is located ahead of the support, does not lock the swinging movement, a fact which involves that the tip portion should be provided with a progressively arched shape upwardly and forwardly, or that the transversely extending channel renders such a soft sole portion that a free and unrestricted lifting movement is achieved, which is correctly limited upwardly.

The device according to the invention allows for an orthopedic boot, and it can have the shape of an ordinary walking-tour boot having a sole adapted to the natural shape of the foot. This involves that the boot can also be used for usual hiking, at the same time as the boot can be given a natural, low and compact structure.

From DE Auslegeschrift No. 26 22 966 there is known a cross-country skiing boot having an extension of the boot sole arranged ahead of the boot. It is true that in this extension there are provided transversely extending shaft portions which can be engaged with locking means on the ski itself, but such a boot cannot fulfil the above-mentioned requirements for an orthopedic boot and be used as a usual hiking boot.

From NO patent specification No. 109,420 there is known a ski binding of the type comprising ears abutting against the toe portion of the ski boot, as well as means for securing the boot from displacement out of the ears in rearward direction, as well as means for preventing the lifting of the boot from the ears. In the present ski binding it is not necessary with ears or toe irons at all.

Further, there is from NO patent specification No. 147 585 known a ski binding having a house-shaped toe iron provided with side ears and being adapted for co-operation with a fore sole extension of a ski boot.

From DE Offenlegungsschrift No. 29 37 347 there is also known a ski binding device, in which the ski binding is arranged to lock a marked protruding portion of the boot sole.

Finally, there is from DE Offenlegungsschrift No. 33 20 559 known a ski binding device for a cross-country racing ski, in which a boot sole extension ahead of the boot is provided with a hoop, which in turn is attached in the ski binding.

None of the above-mentioned publications meet the requirements as stated in the preamble, of a ski binding and a footwear which at the same time can be used as a ski boot and an ordinary hiking footwear.

In the following the invention will be further described, reference being had to the drawing, which illustrates embodiments of the device according to the present invention.

FIGS. 10*a*–10*d* is a view from the underside, a perspective view, a side view and an end view, respectively, of an alternative embodiment of the device according to the invention.

FIGS. 11*a*–11*d* show correspondingly yet another embodiment of the device according to the invention.

Figure 12A:
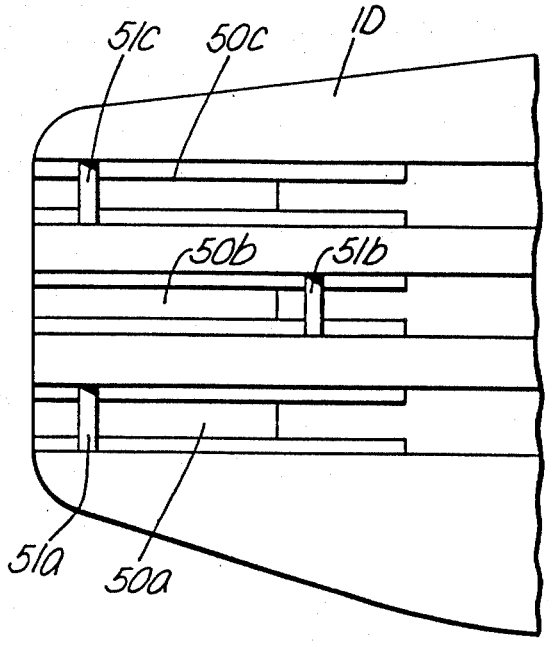
Figure 12B:
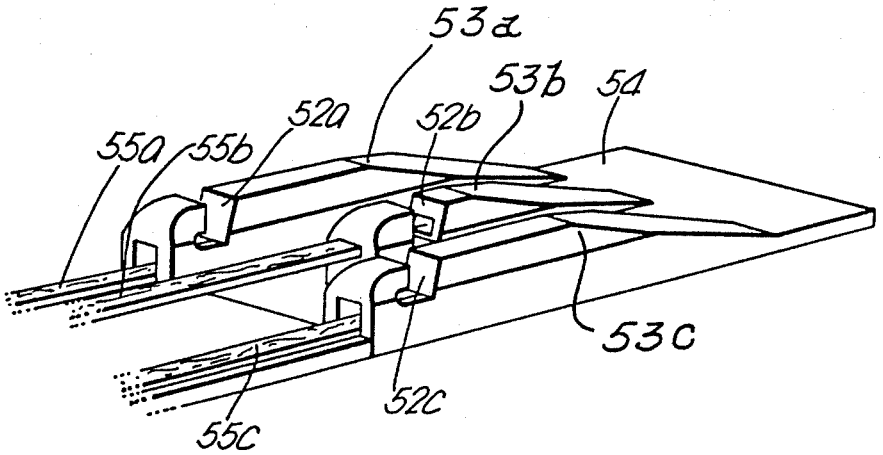

FIGS. 12*a* and 12*b* depict a view from the underside and a perspective view, respectively, of a further embodiment of the device according to the invention.

Figure 1:
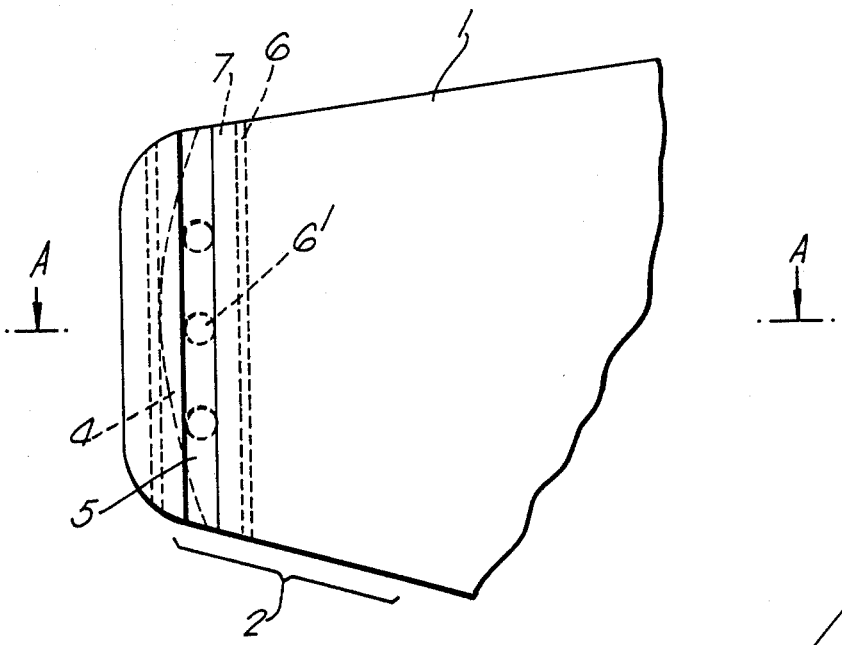
FIG. 1 is a fractional view as seen from the underside of a first embodiment of a boot sole according to the invention.

In FIG. 1, which is a fraction as seen from the underside of a first embodiment of a boot sole according to the invention, the sole itself is designated by 1. As also appearing from FIG. 2, which is a side view of the sole 1 in FIG. 2, the sole is provided with attachment portions or devices provided in the sole surface in the area of the toe portion 2, which correspond to the toe portion 2' of the foot 3 to be placed in the boot 4, which is here illustrated with a fraction of its upper leather.

Figure 2:
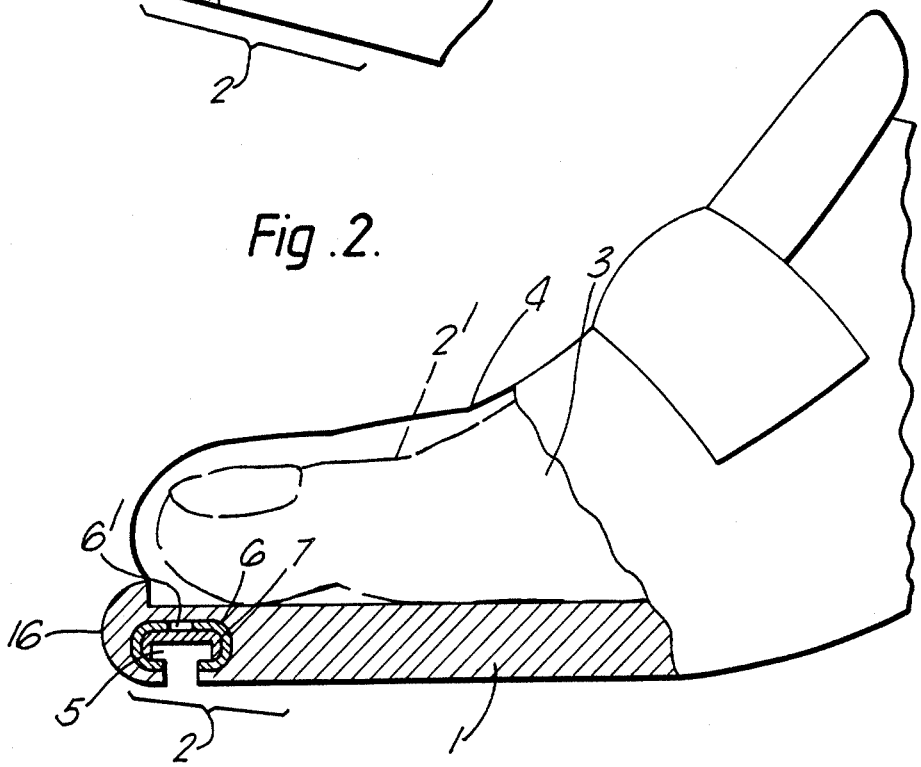
FIG. 2 is a section through the sole, taken along the line A—A in FIG. 1.

In the embodiment illustrated in FIGS. 1 and 2 of the attachment portions these can generally comprise one or more transverse channels, and in the present case one channel 5 which is provided transversely to the sole 1, and which is reinforced by means of a downwardly open sleeve 6 which in turn is embraced by an attachment means 7 which can be the sole material itself and which binds the sleeve 6 to the sole 1.

Due to molding reasons and with a view to the bendability of the sole the sleeve can reasonably well be divided in several parts.

In the illustrated embodiment the sleeve 6 is provided in one piece, and is provided with a hole 6' through which the molding material, i.e. the sole in formable condition can penetrate and form further attachment for the sleeve 6.

The said reinforcement or sleeve 6 is adapted to co-operate with locking means which are provided on the ski, for example of the type illustrated in FIGS. 3 to 6, and which will be discussed in the following.

Figure 3:
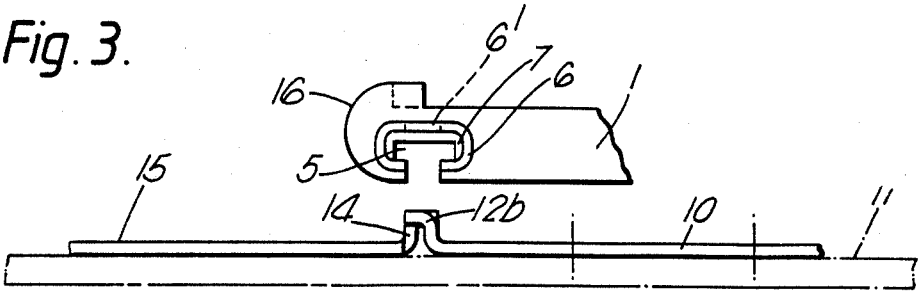
FIG. 3 is a fraction of a side view of a first embodiment of the locking means according to the present invention, depicted in a non-locking position.
Figure 4:
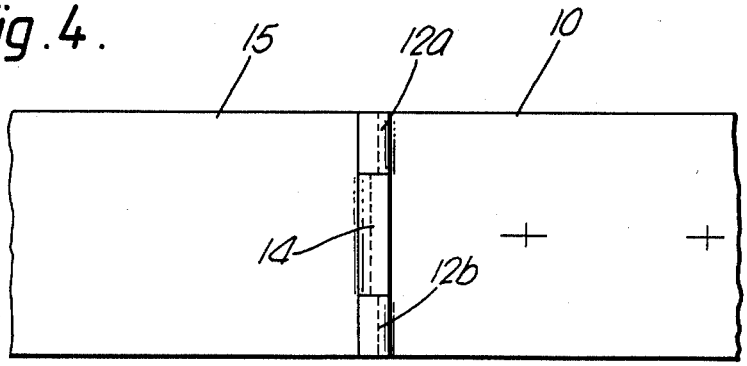
FIG. 4 is a plan view of the locking means in FIG. 3.

In FIGS. 3 and 4, comprising a side view and a plan view, respectively, of a first embodiment of locking means which can co-operate with the attachment portions of the sole surface 1 illustrated in FIGS. 1 and 2, the locking means comprise a first plate 10 which by means of appropriate, not illustrated attachment means is arranged stationary on a ski 11, the plate 10 at its first end having a flat configuration, whereas it at the other end is provided with two hook-shaped portions 12*a* and 12*b*, respectively, protruding from the main portion of the plate. Between the hook-shaped portions 12*a* and 12*b* there is provided a flat portion 13, across which a hook-shaped portion 14 on a second displaceable plate 15 on the ski 11 can move. This involves that the hook-shaped locking means 12*a*, 12*b* and 14 can take a non-locking position, as it appears from FIGS. 3 and 4, or a locking position, as it appears from FIGS. 5 and 6.

Figure 5:
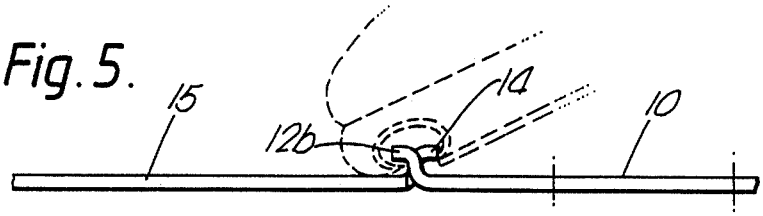
FIG. 5 is a side view similar to FIG. 3 and illustrates the locking means in a boot locking position.
Figure 6:
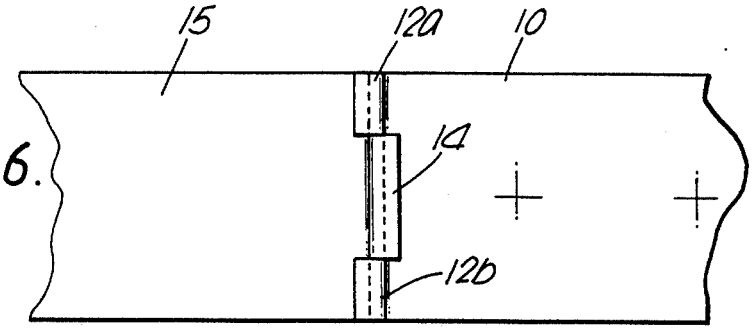
FIG. 6 is a plan view of FIG. 5.

In FIG. 3 the locking means, i.e. the hook-shaped means 12*a*, 12*b* and 14, are shown in a position in which the downwardly open sleeve 6 in the boot sole 1 can be threaded onto the said hook-shaped means, whereas in FIG. 5 the hook-shaped means 14 and 12*a*, 12*b* are displaced relative to each other, so that the said locking means are in engagement with the sleeve 6 for locking the sole relative to the ski 11.

By this form of attachment means it is achieved that the boot with its sole 1 is locked to the ski 11 in the area of the axis for the pivoting movement of the foot. Since the channel 5 with its sleeve 6 and the locking means 12, 12*b* and 14 extends across the total width of the boot, there is achieved a safe side guidance without play about a fixed axis. This implies that there is achieved a good control over the ski, even with the foot in fully swung up position. The described supporting or hinge system operates as a bearing. A prerequisite here is that the sole tip 2 lying ahead of the support, does not lock the swinging movement, but is shaped with an arched front as illustrated by reference numeral 16 in FIGS. 2 and 5.

Figure 7:
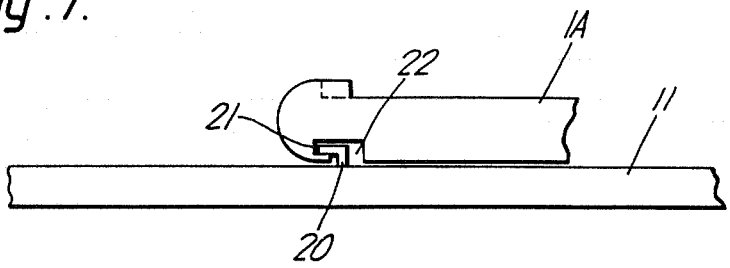
FIG. 7 is a diagrammatical view of a second embodiment of a device according to the invention.

Another embodiment of the locking mechanism is illustrated in FIG. 7, in which the locking means on the ski 11 are constituted by a plurality of angle-shaped studs 20 which can come into engagement with the fore edge 21 of a channel 22 in the boot sole 1A. In the fore edge 21 of the sole channel 22 there can in this case be molded a reinforcement, into which the studs 20 can be passed when the sole tip is subjected to a releasable pressure straight from the front.

Figure 8:
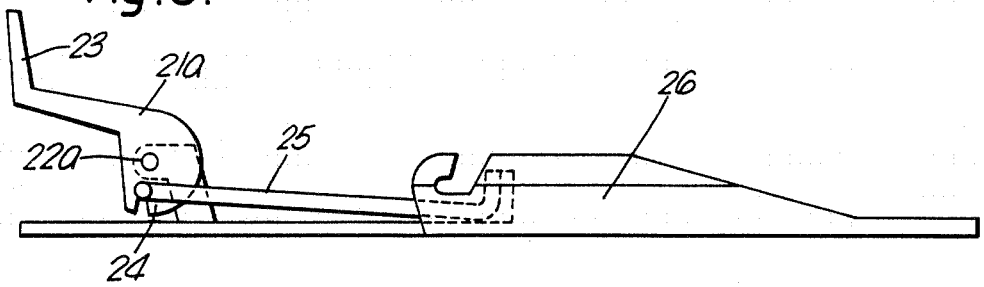
FIG. 8 is a side view of an embodiment of a locking mechanism which can be used in the device according to the invention, the mechanism here being shown in non-locking position.
Figure 9:
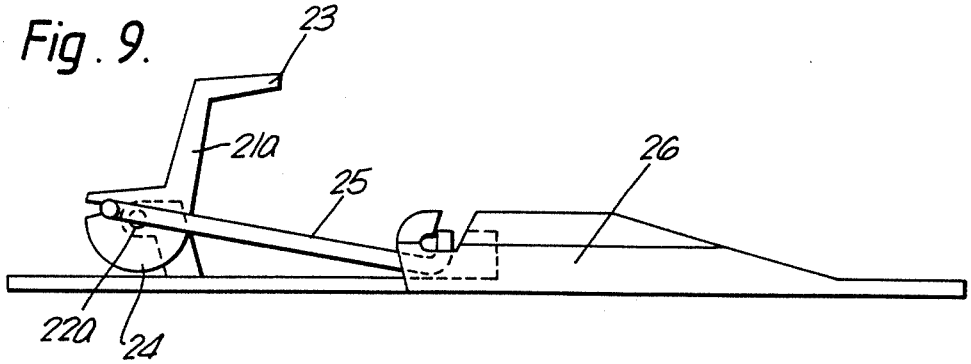
FIG. 9 is a side view similar to FIG. 8, but illustrates the mechanism locking position.

In FIGS. 8 and 9 there are illustrated side views of an embodiment of a locking mechanism which can be used in connection with the device according to the invention, the mechanism in FIG. 8 being depicted in non-locking position, whereas the mechanism in FIG. 9 is depicted in a locking position. The mechanism illustrated in FIGS. 8 and 9 comprises a locking lever rod 21*a* which can pivot about an axis 22*a*, and which comprises a longer manoeuvring arm 23 and a shcrter arm 24 which is connected to locking arms 25 extending from the shorter arm 24 of the locking lever rod to the area of the binding 26, which for example can be of the type illustrated in FIG. 10*b* and FIG. 11*b* respectively.

It is to be understood that in connection with the previously discussed embodiment illustrated in FIGS. 1 to 6 and FIG. 7, respectively, the locking mechanism illustrated in FIGS. 8 and 9 can be so implemented that the locking arms 25 influence, respectively are substituted by the displaceable plate 15 equipped with locking means 14 co-operating with other locking means 12*a*, 12*b* on the second plate 10.

Figure 10A:
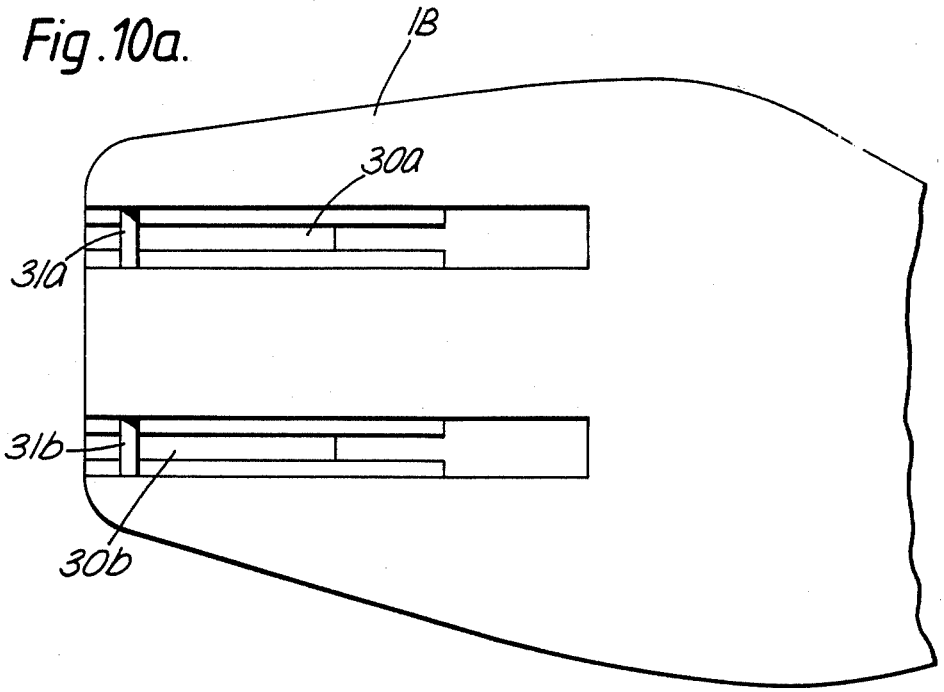
Figure 10C:
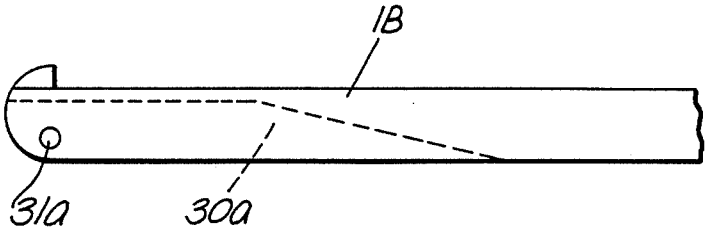
Figure 10D:
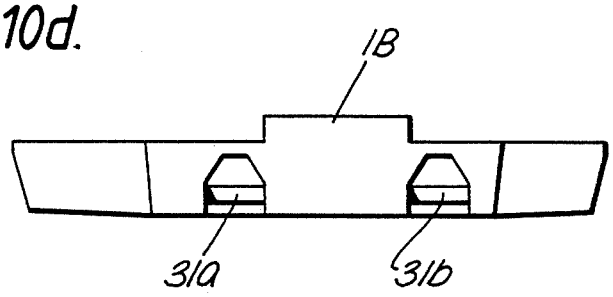
Figure 10B:
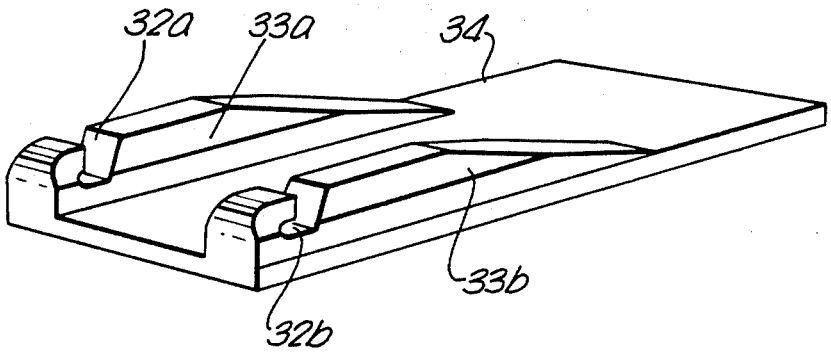
Figure 11B:
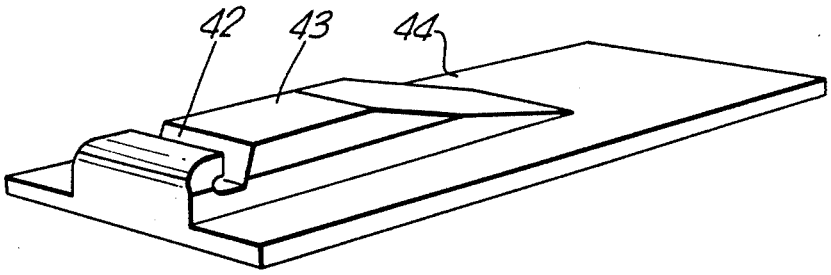
Figure 11A:
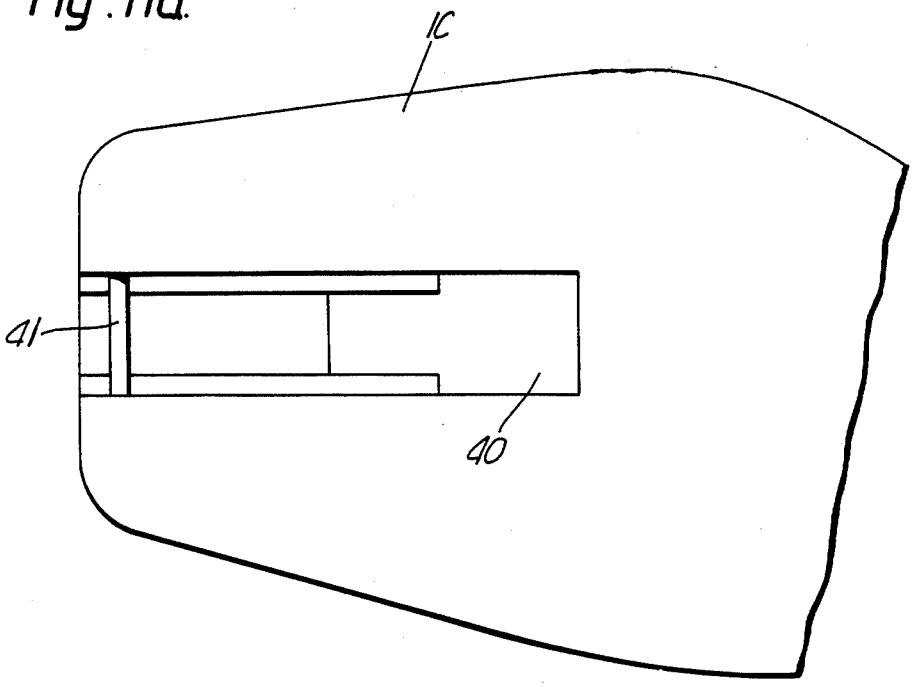
Figure 11C:
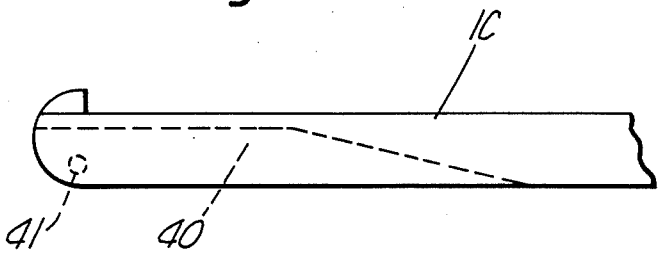
Figure 11D:
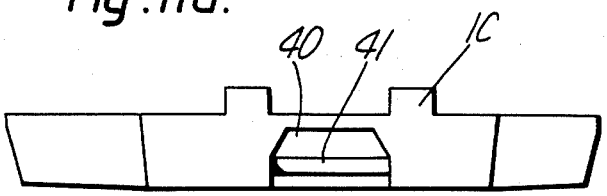

In connection with FIGS. 10*a*–10*d* the binding illustrated in FIG. 10*b* is adapted to co-operate with a boot sole of the type shown in FIG. 10*a* and here designated by reference numeral 1B. The boot sole is here provided with a plurality of channels or tracks, here 30*a* and 30*b* there being provided therein attachment means in the form of shaft pieces, 31*a* and 31*b*, respectively, which are adapted to come into engagement in recesses 32*a* and 32*b*, respectively, provided in elevations, 33*a* and 33*b* respectively, of the binding 34 illustrated in FIG. 10*b*. When the sole 1B is put into position on the binding 34 in FIG. 10*b*, the shaft pieces 31*a*, 31*b* will be passed into the recesses 32*a*, 32*b* when the locking mechanism 21*a* illustrated in FIG. 8 takes the depicted non-locking position, whereafter the locking mechanism 21*a* by means of the manoeuvring arm 23 is brought to a locking position as shown in FIG. 9. Also here the locking means will co-operate with the attachment portions provided in the sole portion of the footwear in the area of the foot toe portion, and there are achieved the same favourable effects as in the embodiments discussed in connection with the above-mentioned FIGS. 1–6 and FIG. 7.

Since the channels in the sole 1B do not extend the full width of the sole, the above-mentioned elevations 33*a*, 33*b* will fit into the tracks 30*a*, 30*b* with the purpose of aiding in the guidance of the ski.

The embodiment illustrated in FIGS. 11*a*–11*d* will function in the same manner as discussed in connection with FIGS. 10*a*–10*d* the embodiment illustrated in FIGS. 11*a*–11*d* departing from the previously mentioned in that the binding 44 here comprise only one elevation 43 having a transverse recess 42, the boot sole 1C being provided with a single track or channel 40, in which there is provided a shaft piece 41.

It is to be understood that the sole can be provided with several channels in which attachment portions can be arranged so as to give a free choice of the area of the sole in which the boot is to be attached to the ski. If the clamping point is displaced to a sole area which is located further behind, a firm binding can be achieved, which can be favourable in loose snow or during downhill skiing. With a setting further ahead on the boot sole there is achieved an unloaded hinge effect, and a looser binding is thereby obtained.

In FIG. 12*a* there is shown a boot sole 1D which is provided with three channels or tracks 50*a*, 50*b* and 50*c*, there being provided in each track shaft pieces or bolts 51*a*, 51*b* and 51*c*, respectively, which are arranged in a staggered fashion, i.e. the shaft pieces 51*b* and 51*c* following a line in the transversal direction, whereas the shaft piece 51*b* is offset rearwardly in the longitudinal direction of the sole.

The said shaft pieces 51*a*, 51*b* and 51*c* are adapted to come into engagement with an individual, transverse recess 52*a*, 52*b* and 52*c*, respectively, provided in elevations 53*a*, 53*b* and 53*c*, respectively, on the binding 54 illustrated in FIG. 12*b*.

In FIG. 12*b* there are also shown three locking arms 55*a*, 55*b* and 55*c* which extend from a not illustrated locking mechanism further ahead on the ski, and which, as an example, can correspond to the embodiment discussed in connection with FIGS. 8 and 9.

However, the two outer locking arms 55*a* and 55*c* are in the embodiment illustrated in FIGS. 12*a* and 12*b*, arranged for co-operating in pairs, whereas the intermediate locking arm 55*b* can be moved between a non-locking and locking position independently of the arms 55*a* and 55*c*.

In the embodiment illustrated in FIGS. 12*a* and 12*b*, the sole 1D can thus on the one hand be locked to a supporting point which is constituted by the fore shaft pieces 51*a* and 51*c*, and on the other hand be locked to a point rearwardly of the fore supporting point, i.e. at the shaft piece 51b.

When the sole 1D is put in position on the binding 34 in FIG. 12*b*, the shaft pieces 51*a*, 51*b* and 51*c* will be passed into individual recesses in the binding, and the sole can thereafter, according to choice, be locked only at the fore shaft pieces 51*a* and 51*c*. The rear shaft piece 51*b* will then move freely up and down in the recess 52*b* until the locking arm 55*b* in the central channel is pushed to a locking position and with its hook-shaped end portion locks over the shaft piece 51*b*.

It is to be understood that variants of the above discussed combination of locking points can be arranged, the number and positions of the recesses and the shaft pieces and bolts being varied, all in dependence of the field of application of the binding.

The present device, apart from giving instructions for a binding which is simple and compact in its structure, implies that a boot can be used which is not only applicable for cross-country skiing, but also for usual hiking.

The discussed channels or tracks in the boot sole in the area of the user's toe portion render a good bending of the sole, and even if snow particles or particles of other material should enter the sole track, these particles could be easily removed or fall out by appropriate bending of the boot sole. In the tracks or channels in the boot sole there can possibly be arranged detachable inserts, which can be used during hiking, possibly during jogging prior to a competition, and which quickly and easily can be removed when putting on the skis.

An alternative embodiment of the above discussed attachment means is to the effect that the locking means on the ski is so adapted that they can be displaced by the influence of a reinforcement in the footwear sole, so that the locking means come into position in the sole for thereafter to flop back in a sole locking position. It is then achieved that the user when attaching the boot to the ski only need to step down onto the "binding", and this will then flop into position in the sole track. It is then not necessary for the user to bend forward for fixing the binding, which involves a simplification for e.g. children and older people. By disengaging such an embodiment a disengaging mechanism can be used which is influenced by the tip of a ski stick, and both the attachment and the disengagement of the ski can take place from an upright position.

It is claimed:

1. A device for attaching a boot to an elongate ski comprising binding means on said ski having a plurality of longitudinally extending elevated portions mounted thereon that may be received, respectively, in a corresponding number of channels provided within the sole portion of said boot, said elevated portions each having at least one recess defined therein for receiving respectively, a plurality of shaft pieces that are transversely mounted in said channels; and means for locking said recesses shut so that each of said respective shaft pieces may be secured in said recesses and said ski may be attached to said boot.

2. A device for attaching a boot to an elongate ski according to claim 1, wherein three elevated portions are provided on said binding means, with the outermost elevated portions having recesses which are positioned so as to be substantially even with each other along the length of said ski, and locking means which are mounted for common movement;

the inner elevated portion having a recess which is positioned so as to be offset along the length of the ski with respect to the recesses of the outermost elevated portions, whereby a skier may elect to lock only the outermost elevated portions to their corresponding shaft pieces in the ski boot so that the boot may pivot with respect to the ski, or all three elevated portions to their respective shaft pieces to securely fasten the ski to the boot.

3. A method of fastening a boot to a ski comprising (a) providing a number of channels in the sole of a boot, each of said channels having a transversely extending shaft piece disposed therein;

(b) providing a corresponding number of elevated portions on the binding of a ski, each of said elevated portions having a recess therein corresponding to a respective shaft piece;

(c) inserting said elevated portions of the binding into the corresponding channels in the sole of the ski boot, with said shaft pieces fitting into their respective recesses; and (d) locking at least one of said shaft pieces into its respective recess.

4. A method of fastening a boot to a ski as set forth in claim 3, wherein the channels provided in step (a) and the elevated portions provided in step (b) are three in number, and the recess and corresponding shaft piece in the inner portion and channel respectively are positioned so as to be offset along the length of the ski with respect to the recesses and corresponding shaft portions of the outermost portions and channels, respectively, and wherein step (d) comprises locking only the outermost shaft pieces within their respective recesses, whereby the boot may pivot relative to the ski.

5. A method of fastening a boot to a ski as set forth in claim 3, wherein step (d) comprises locking all of said shaft pieces within their respective recesses to securely fasten said boot to said ski.

* * * * *